US011789480B2

(12) United States Patent
Huang et al.

(10) Patent No.: US 11,789,480 B2
(45) Date of Patent: Oct. 17, 2023

(54) POWER MANAGING SYSTEM AND METHOD

(71) Applicant: ANPEC ELECTRONICS CORPORATION, Hsinchu (TW)

(72) Inventors: Tzu-Chien Huang, Hsinchu (TW); Hsin-Tsung Hsieh, Hsinchu (TW); Shang-Lin Yang, Hsinchu (TW)

(73) Assignee: ANPEC ELECTRONICS CORPORATION, Hsinchu (TW)

( * ) Notice: Subject to any disclaimer, the term of this patent is extended or adjusted under 35 U.S.C. 154(b) by 0 days.

(21) Appl. No.: 17/675,051

(22) Filed: Feb. 18, 2022

(65) Prior Publication Data

US 2023/0117990 A1 Apr. 20, 2023

(30) Foreign Application Priority Data

Oct. 14, 2021 (TW) ..... 110138054

(51) Int. Cl.
*G05F 1/613* (2006.01)

(52) U.S. Cl.
CPC ..... *G05F 1/613* (2013.01)

(58) Field of Classification Search
None
See application file for complete search history.

(56) References Cited

U.S. PATENT DOCUMENTS

| | | | | |
|---|---|---|---|---|
| 6,850,048 | B2 * | 2/2005 | Orr | H02M 3/33569 323/299 |
| 7,263,625 | B2 * | 8/2007 | Katoh | G06F 1/26 713/300 |
| 7,464,275 | B2 * | 12/2008 | Lim | G06F 1/26 713/300 |
| 7,486,064 | B2 * | 2/2009 | Sasaki | H02M 1/36 323/299 |
| 7,568,117 | B1 * | 7/2009 | Fernald | H02M 3/156 363/21.01 |
| 9,052,727 | B2 | 6/2015 | Chen et al. | |
| 10,725,516 | B2 * | 7/2020 | Jeon | G11C 5/148 |
| 10,877,541 | B1 * | 12/2020 | Benjamin | G11C 16/32 |
| 11,374,486 | B2 * | 6/2022 | Zhou | G06F 1/26 |
| 2009/0315397 | A1 * | 12/2009 | Udo | H02M 3/1584 307/31 |
| 2019/0187772 | A1 * | 6/2019 | Boudoux | H02M 1/36 |

FOREIGN PATENT DOCUMENTS

TW 201334380 A1 8/2013

* cited by examiner

*Primary Examiner* — Thomas J. Hiltunen
(74) *Attorney, Agent, or Firm* — Li & Cai Intellectual Property (USA) Office

(57) ABSTRACT

A power managing system and method are provided. When an under voltage lockout circuit determines that a common voltage of the power managing system is lower than a first lockout voltage, the under voltage lockout circuit outputs a first under voltage lockout signal for controlling one of a plurality of power converters that supplies a highest output voltage to rapidly reduce its output voltage to a zero value. Then, the under voltage lockout circuit outputs a second under voltage lockout signal for controlling another one of the power converters that supplies a lowest output voltage to gradually reduce its output voltage to the zero value.

19 Claims, 7 Drawing Sheets

POWER MANAGING SYSTEM AND METHOD

CROSS-REFERENCE TO RELATED PATENT APPLICATION

This application claims the benefit of priority to Taiwan Patent Application No. 110138054, filed on Oct. 14, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to power, and more particularly to a power managing system and method.

BACKGROUND OF THE DISCLOSURE

More and more system-on-chips (SOCs) are manufactured by an advanced process with an advanced process node being, e.g., below 28 nm. In the advanced process, while the system-on-chips are made smaller in size, an operating voltage and signal levels of a power management system used thereby are not reduced. Therefore, circuit designs of the system-on-chips have become challenging. The system-on-chip receives output voltages from the power management system for operation. The output voltages of the power management system may fall within a wide voltage range, such as 1.8V to 3.3V. When a hot plugging event occurs, a highest voltage difference between two of the output voltages received by the system-on-chip may be higher than a voltage threshold that the system-on-chip can withstand. As a result, parts of the system-on-chip may be damaged, or the entire system-on-chip may even need to be scrapped.

SUMMARY OF THE DISCLOSURE

In response to the above-referenced technical inadequacies, the present disclosure provides a power managing system includes a power converter circuit and an under voltage lockout. The power converter circuit includes a plurality of power converters. The power converters are respectively configured to supply a plurality of output voltages. One of the plurality of power converters that supplies a lowest one of the plurality of output voltages is defined as a first power converter. Another one of the plurality of power converters that supplies a highest one of the plurality of output voltages is defined as a second power converter. The under voltage lockout circuit is coupled to a common voltage and connected to the power converter circuit. When the common voltage determines that the common voltage is lower than a first lockout voltage, the under voltage lockout circuit outputs a first under voltage lockout signal to the second power converter. Then, the second power converter rapidly decreases the output voltage of the second power converter to a zero value according to the first under voltage lockout signal. After the output voltage of the second power converter decreases to the zero value, the under voltage lockout circuit outputs a second under voltage lockout signal to the first power converter. Then, the first power converter gradually decreases the output voltage of the first power converter to the zero value according to the second under voltage lockout signal.

In certain embodiments, after the output voltage of the second power converter rapidly decreases to the zero value, the under voltage lockout circuit determines whether or not the common voltage decreases to be lower than a second lockout voltage. The second lockout voltage is lower than the first lockout voltage. When the common voltage decreases to be lower than the second lockout voltage, the under voltage lockout circuit outputs the second under voltage lockout signal to the first power converter, and then the first power converter gradually decreases the output voltage of the first power converter to the zero value according to the second under voltage lockout signal.

In certain embodiments, the power managing system further includes a main controller circuit. The main controller circuit is connected to the power converter circuit and the under voltage lockout circuit. The main controller circuit is configured to control the second power converter according to the first under voltage lockout signal from the under voltage lockout circuit. The main controller circuit is configured to control the first power converter according to the second under voltage lockout signal from the under voltage lockout circuit.

In certain embodiments, the power managing system further includes a timer circuit. The timer circuit is connected to the main controller circuit. When the output voltage of the second power converter starts decreasing, the main controller circuit controls the timer circuit to start timing. When a time being currently timed by the timer circuit reaches a preset time, the timer circuit outputs a timing signal to the main controller circuit. Then, the main controller circuit controls the first power converter to gradually decrease the output voltage of the first power converter to zero value according to the timing signal.

In certain embodiments, when the common voltage decreases to be lower than the first lockout voltage the under voltage lockout circuit outputs a voltage-decreasing instruction signal to the main controller circuit. Then the main controller circuit, based on a reference voltage indicated by the voltage-decreasing instruction signal, controls the second power converter to decrease the output voltage of the second power converter.

In certain embodiments, the power managing system further includes a voltage difference detector circuit. The voltage difference detector circuit is connected to the main controller circuit and the power converter circuit. The voltage difference detector circuit is configured to calculate a difference between the highest one of the plurality of output voltages and the lowest one of the plurality of output voltages. When the voltage difference detector circuit determines that the difference is higher than a preset difference voltage, the voltage difference detector circuit outputs a voltage difference detected signal to the main controller circuit. The voltage difference detector circuit, controls the power converters according to the voltage difference detected signal such that a time point at which the highest one of the plurality of output voltages starts gradually increasing is not the same as a time point at which the lowest one of the plurality of output voltages starts gradually increasing, or such that a time point at which the highest one of the plurality of output voltages starts gradually decreasing is not the same as a time point at which the lowest one of the plurality of output voltages starts gradually decreasing.

In certain embodiments, the voltage difference detector circuit includes a multiplexer, an error amplifier and a comparator. An input terminal of the multiplexer is connected to the power converter circuit. An output terminal of the multiplexer is connected to a first input terminal of the error amplifier and a second input terminal of the error amplifier. A first input terminal of the comparator is connected to an output terminal of the error amplifier. A second input terminal of the comparator is coupled to the preset difference voltage. An output terminal of the comparator is connected to an input terminal of the main controller circuit. The multiplexer selects the highest one of the plurality of output voltages and outputs the highest one of the plurality of output voltages to the first input terminal of the error amplifier. The multiplexer selects the lowest one of the plurality of output voltages and outputs the lowest one of the plurality of output voltages to the second input terminal of the error amplifier. The error amplifier amplifies the difference between the highest one of the plurality of output voltages and the lowest one of the plurality of output voltages to output an error amplified signal to the first input terminal of the comparator. The comparator compares a voltage of the error amplified signal with the preset difference voltage to output the voltage difference detected signal to the main controller circuit.

In certain embodiments, each of the plurality of power converter includes a high-side switch, a low-side switch and a driver circuit. A first terminal of the high-side switch is coupled to an input voltage. A second terminal of the high-side switch is connected to a first terminal of the low-side switch. A second terminal of the low-side switch is grounded. A node between the second terminal of the high-side switch and the first terminal of the low-side switch is connected to a first terminal of an inductor. A second terminal of the inductor is connected to a first terminal of a capacitor. A second terminal of the capacitor is grounded. The driver circuit is connected to a control terminal of the high-side switch and a control terminal of the low-side switch. The main controller circuit is connected to the driver circuit.

In certain embodiments, each of the plurality of power converter further includes an operational amplifier. A first input terminal of the operational amplifier is connected to a digital-analog converter and receives an analog signal from the digital-analog converter. A second input terminal of the operational amplifier is connected to a node between the second terminal of the inductor and the first terminal of the capacitor.

In certain embodiments, each of the plurality of power converter further includes a voltage divider circuit. An input terminal of the voltage divider circuit is connected to the node between the second terminal of the inductor and the first terminal of the capacitor. An output terminal of the voltage divider circuit is connected to the input terminal of the multiplexer. The second input terminal of the operational amplifier is connected to the node between the second terminal of the inductor and the first terminal of the capacitor through the voltage divider circuit.

In certain embodiments, each of the plurality of power converter further includes a discharging circuit. The discharging circuit is connected to the node between the second terminal of the inductor and the first terminal of the capacitor. The discharging circuit is configured to adjust a voltage of the node between the second terminal of the inductor and the first terminal of the capacitor.

In certain embodiments, the discharging circuit includes a plurality of resistors. The resistors are connected to each other in parallel. A first terminal of each of the plurality of resistors is connected to the node between the second terminal of the inductor and the first terminal of the capacitor. A second terminal of each of the plurality of resistors is grounded.

In certain embodiments, the discharging circuit of each of the plurality of power converter further includes a switch component. A control terminal of the switch component is connected to the main controller circuit. A first terminal of the switch component is connected to a second terminal of each of the plurality of resistors. A second terminal of the switch component is grounded.

In certain embodiments, when the common voltage decreases to be lower than the first lockout voltage, the driver circuit turns on the low-side switch in the second power converter such that a speed at which the output voltage of the second power converter decreases to the zero value is accelerated.

In another aspect, the present disclosure provides a power managing method. The power managing method includes the following steps: supplying a plurality of output voltages respectively by a plurality of power converters, defining one of the plurality of power converters that supplies a lowest one of the plurality of output voltages as a first power converter, and defining another one of the plurality of power converters that supplies a highest one of the plurality of output voltages as a second power converter; detecting a common voltage used by the plurality of power converters; determining whether or not the common voltage decreases to be lower than a first lockout voltage, in response to determining that the common voltage does not decrease to be lower than the first lockout voltage, continually detecting the common voltage, and in response to determining that the common voltage decreases to be lower than the first lockout voltage, performing a next step; rapidly decreasing the output voltage of the second power converter to a zero value; and gradually decreasing the output voltage of the first power converter to the zero value.

In certain embodiments, the power managing method further includes the following steps: after the output voltage of the second power converter is rapidly decreased to the zero value, determining whether or not the common voltage decreases to be lower than a second lockout voltage, in response to determining that the common voltage does not decrease to be lower than the second lockout voltage, continually detecting the common voltage and determining whether or not the common voltage decreases to be lower than the second lockout voltage, and in response to determining that the common voltage decreases to be lower than the second lockout voltage, performing a next step; and gradually decreasing the output voltage of the first power converter to the zero value.

In certain embodiments, the power managing method further includes the following steps: start timing when the output voltage of the second power converter is rapidly decreased to the zero value; and determining whether or not a time being currently timed by the timer circuit reaches a preset time, in response to determining that the time does not reach the preset time, returning to the previous step to continue timing, and in response to determining that the time reaches the preset time, controlling the first power converter to gradually decrease the output voltage of the first power converter to the zero value.

In certain embodiments, the power managing method further includes the following steps: determining whether or not the common voltage decreases to be lower than the first lockout voltage, in response to determining that the common voltage does not decrease to be lower than the first lockout voltage, continually detecting the common voltage and determining whether or not the common voltage decreases to be lower than the first lockout voltage, and in response to determining that the common voltage decreases to be lower than the first lockout voltage, performing a next step; and controlling the second power converter to decrease the output voltage of the second power converter based on a reference voltage.

In certain embodiments, the power managing method further includes the following steps: selecting the highest one of the plurality of output voltages and the lowest one of the plurality of output voltages; calculating a difference between the highest one of the plurality of output voltages and the lowest one of the plurality of output voltages; determining whether or not the difference is higher than a preset difference voltage, in response to determining that the difference is not higher than the preset difference voltage, returning to the previous step, and in response to determining that the difference is higher than the preset difference voltage, performing a next step; and controlling the power converters such that a time point at which the highest one of the plurality of output voltages starts gradually increasing is not the same as a time point at which the lowest one of the plurality of output voltages starts gradually increasing.

In certain embodiments, the power managing method further includes the following steps: selecting the highest one of the plurality of output voltages and the lowest one of the plurality of output voltages; calculating a difference between the highest one of the plurality of output voltages and the lowest one of the plurality of output voltages; determining whether or not the difference is higher than a preset difference voltage, in response to determining that the difference is not higher than the preset difference voltage, returning to the previous step, and in response to determining that the difference is higher than the preset difference voltage, performing a next step; and controlling the power converters such that a time point at which the highest one of the plurality of output voltages starts gradually decreasing is not the same as a time point at which the lowest one of the plurality of output voltages starts gradually decreasing.

As described above, the present disclosure provides the power managing system and method. The output voltages of the power converters are controlled to begin increasing or decreasing respectively at different time points. In particular, the highest one and the lowest one of the output voltages of the power converter circuit are decreased to the zero value respectively within the different time intervals. As a result, an excessive voltage difference between two of the output voltages of the power converter circuit can be prevented from appearing within a same one of the time intervals. Therefore, when circuit components (such as a single chip of a system) receive the output voltages of the power converters, the circuit components can avoid being damaged by the excessive voltage difference.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
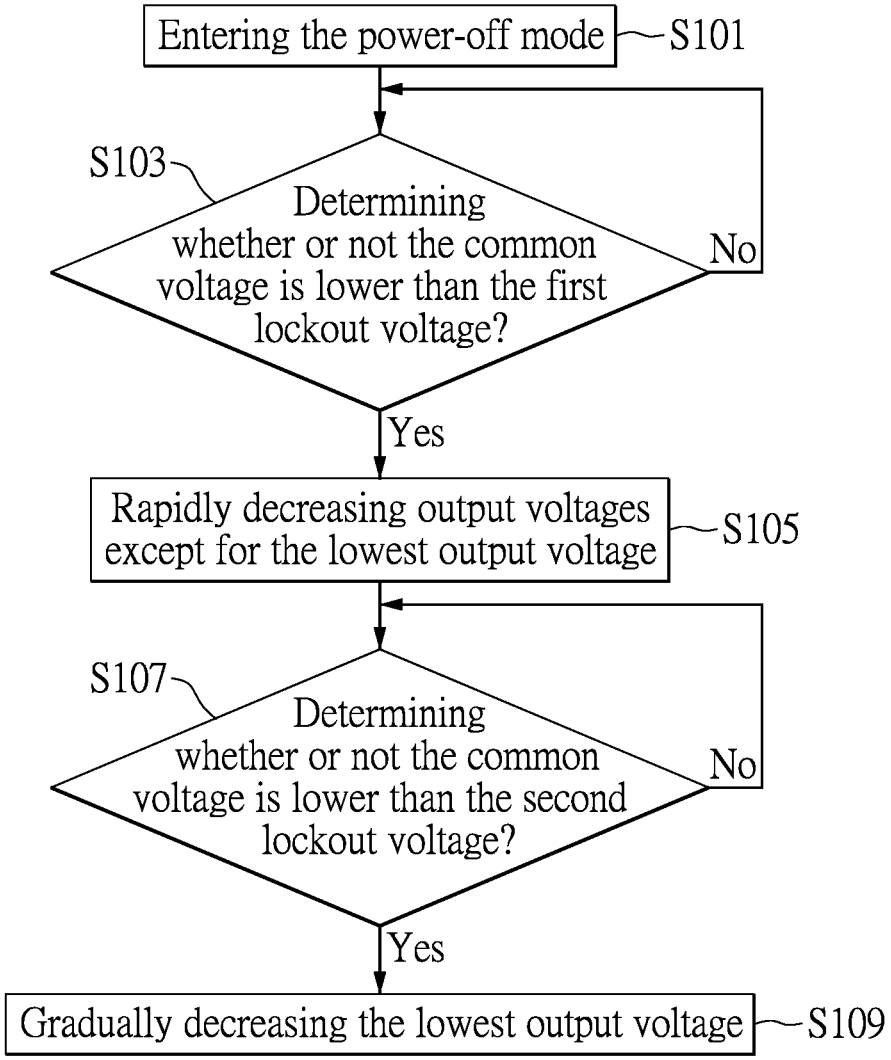
FIG. 1 is a first flowchart diagram of steps of a power managing method according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 5:
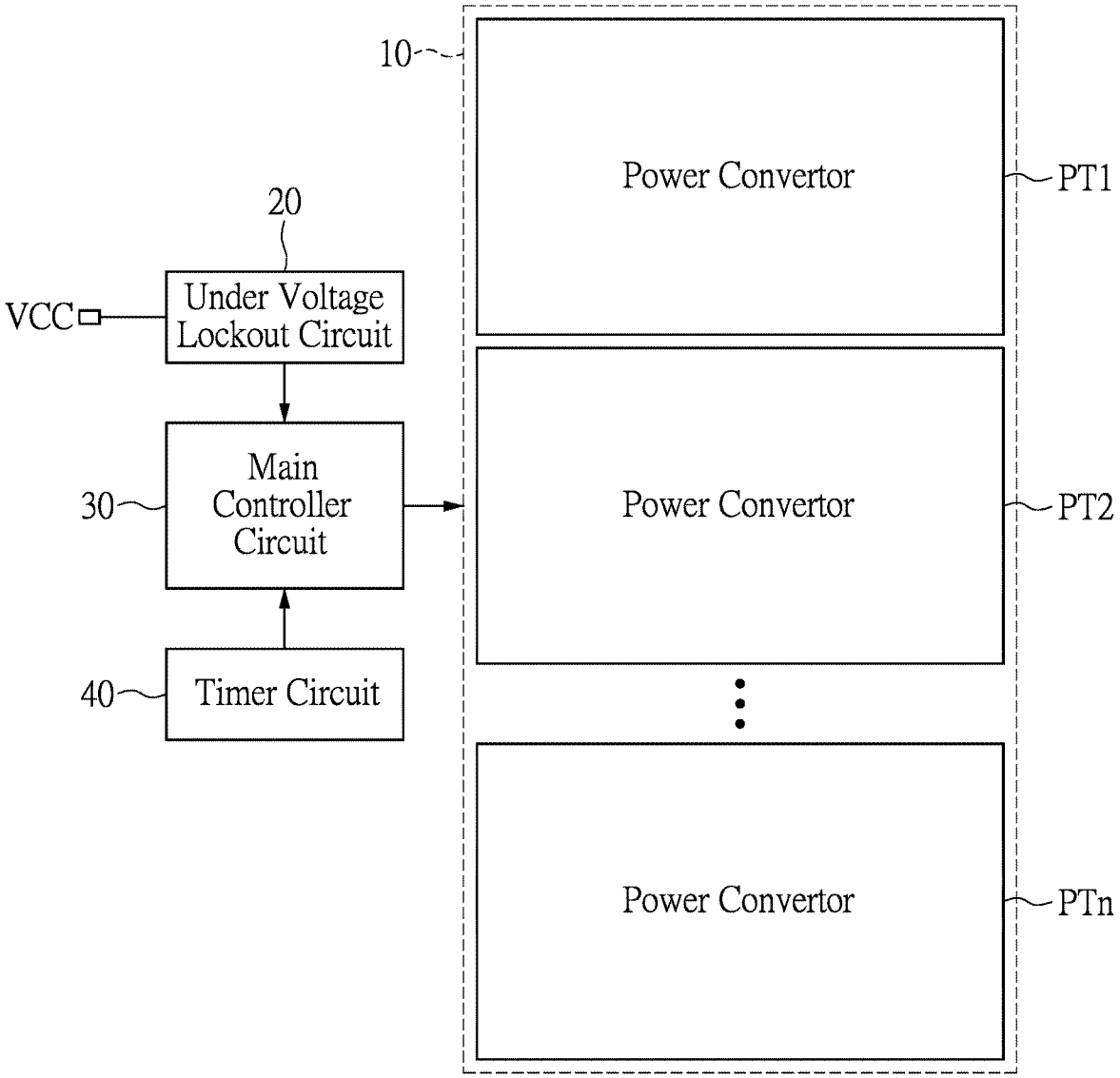
FIG. 5 is a block diagram of a power managing system according to the embodiment of the present disclosure.
Figure 7:
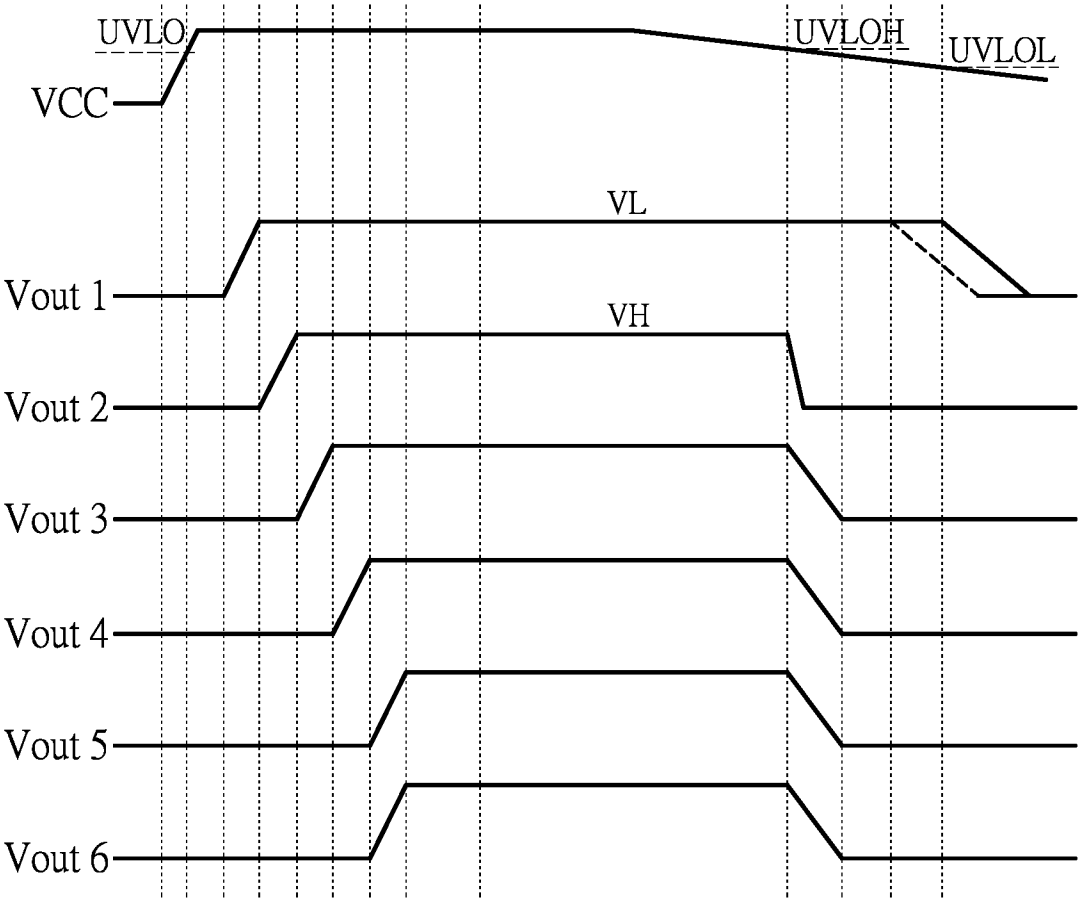
FIG. 7 is a waveform diagram of the power managing system and method according to the embodiment of the present disclosure.

Reference is made to FIGS. 1, 5 and 7, in which FIG. 1 is a first flowchart diagram of steps of a power managing method according to an embodiment of the present disclosure, FIG. 5 is a block diagram of a power managing system according to the embodiment of the present disclosure, and FIG. 7 is a waveform diagram of the power managing system and method according to the embodiment of the present disclosure.

In the embodiment of the present disclosure, the power managing method may include steps S101 to S109 as shown in FIG. 1. Steps S101 to S109 may be performed by a power converter circuit 10, a under voltage lockout circuit 20 and a main controller circuit 30 that are included in the power managing system as shown in FIG. 5.

The main controller circuit 30 may be connected to the power converter circuit 10 and the under voltage lockout circuit 20. The power converter circuit 10 may include a plurality of power converters PT1 to PTn. The power converters PT1 to PTn are configured to respectively supply a plurality of output voltages to an external circuit component such as a single chip of a system (not shown in figures).

For example, the power managing system includes six ones of the power converters PT1 to PTn shown in FIG. 5. That is, the power managing system includes the power converters PT1 to PT6. The power converters PT1 to PT6 respectively supply output voltages Vout1 to Vout6 shown in FIG. 7. A lowest one of the plurality of output voltages Vout1 to Vout6 is supplied by the power converter PT1 among the plurality of power converters PT1 to PT6. As described herein, the lowest one of the plurality of output voltages Vout1 to Vout6 is represented by a lowest output voltage VL, and the power converter PT1 is defined as a first power converter. A highest one of the plurality of output voltages Vout1 to Vout6 is supplied by the power converter PT2 among the plurality of power converters PT1 to PT6. As described herein, the highest one of the plurality of output voltages Vout1 to Vout6 is represented by a highest output voltage VH, and the power converter PT2 is defined as a second power converter. A difference between the lowest output voltage VL supplied by the power converter PT1 and the highest output voltage VH supplied by the power converter PT2 is defined as a limited voltage difference. A purpose of the present disclosure is to prevent the limited voltage difference from occurring between two ones of the plurality of output voltages that are received by the single chip of the system from the power converter circuit 10.

It should be understood that, a number of the power converters PT1 to PTn included in the power converter circuit 10 may be determined according to actual requirements. In addition, the output voltages of some of the power converters PT1 to PTn may have a same voltage value, but the present disclosure is not limited thereto.

In step S101, the power managing system enters a power-off mode.

If necessary, before step S103 is performed, the under voltage lockout circuit 20 may determine whether or not a common voltage VCC is decreasing. For example, the under voltage lockout circuit 20 may determine whether or the common voltage VCC used by the power managing system decreases to be lower than a lockout voltage such as a lockout voltage UVLO as shown in FIG. 7. If the common voltage VCC is lower than the lockout voltage UVLO, step S103 is performed.

In step S103, the under voltage lockout circuit 20 determines whether or not the common voltage VCC decreases to be lower than a first lockout voltage such as a first lockout voltage UVLOH as shown in FIG. 7. For example, the first lockout voltage UVLOH is lower than the lockout voltage UVLO.

If the common voltage VCC does not decrease to be lower than the first lockout voltage, the under voltage lockout circuit 20 may continually detect the common voltage VCC and step S103 is performed again. Conversely, if the common voltage VCC decreases to be lower than the first lockout voltage, step S105 is performed.

In step S105, when the common voltage VCC decreases to be lower than the first lockout voltage, the under voltage lockout circuit 20 may output a first lockout voltage signal to the main controller circuit 30. The main controller circuit 30 may, according to the first lockout voltage signal, rapidly decreases the highest output voltage VH (or the output voltage of the power converter PT2) to a zero value, and rapidly decreases the other output voltages except for the lowest output voltage VL to the zero value.

For example, when the common voltage VCC is lower than the first lockout voltage, the under voltage lockout circuit 20 may output a voltage-decreasing instruction signal to the main controller circuit 30. The main controller circuit 30 may, based on a reference voltage indicated by the voltage-decreasing instruction signal, control the power converter PT2 to rapidly decrease the highest output voltage VH supplied by the power converter PT2. As shown in FIG. 7, the highest output voltage VH decreases more rapidly than the output voltages Vout3 to Vout6, and a time point at which the highest output voltage VH starts decreasing is earlier than a time point at which the lowest output voltage VL starts decreasing.

In step S107, after the power converter PT2 to PTn decrease their output voltages to the zero value, the under voltage lockout circuit 20 determines whether or not the common voltage VCC is lower than a second lockout voltage such as a second lockout voltage UVLOL shown in FIG. 7. As shown in FIG. 7, the second lockout voltage UVLOL is lower than the first lockout voltage UVLOH.

If the common voltage VCC does not decrease to be lower than the second lockout voltage, the under voltage lockout circuit 20 may continually detect the common voltage VCC, and step S107 is performed again. Conversely, if the common voltage VCC decreases to be lower than the second lockout voltage, step S109 is performed.

The under voltage lockout circuit 20 outputs a second lockout voltage signal to the main controller circuit 30. The main controller circuit 30 may, according to the second lockout voltage signal, control the first power converter to gradually decrease the lowest output voltage VL supplied by the first power converter to the zero value.

As decreased above, in the power-off mode, if the first lockout voltage and the second lockout voltage are set, steps 101 to step S109 may be performed. However, in the power-off mode, if only the first lockout voltage is set, but the second lockout voltage is not set, steps S201 to S211 may be performed as decreased in the following.

If steps 101 to S109 or steps S201 to S211 are performed, a time interval within which the highest output voltage VH of the power converter circuit 10 gradually decreases does not overlap a time interval within which the lowest output voltage VL of the power converter circuit 10 gradually decreases. Alternatively, a time point at which the highest output voltage VH of the power converter circuit 10 starts decreasing is not the same as a time point at which the lowest output voltage VL of the power converter circuit 10 starts decreasing. As a result, the difference between each two ones of the output voltages supplied by the power converter circuit 10 cannot be too high at a same time, thereby preventing the external circuit component from being damaged.

Figure 2:
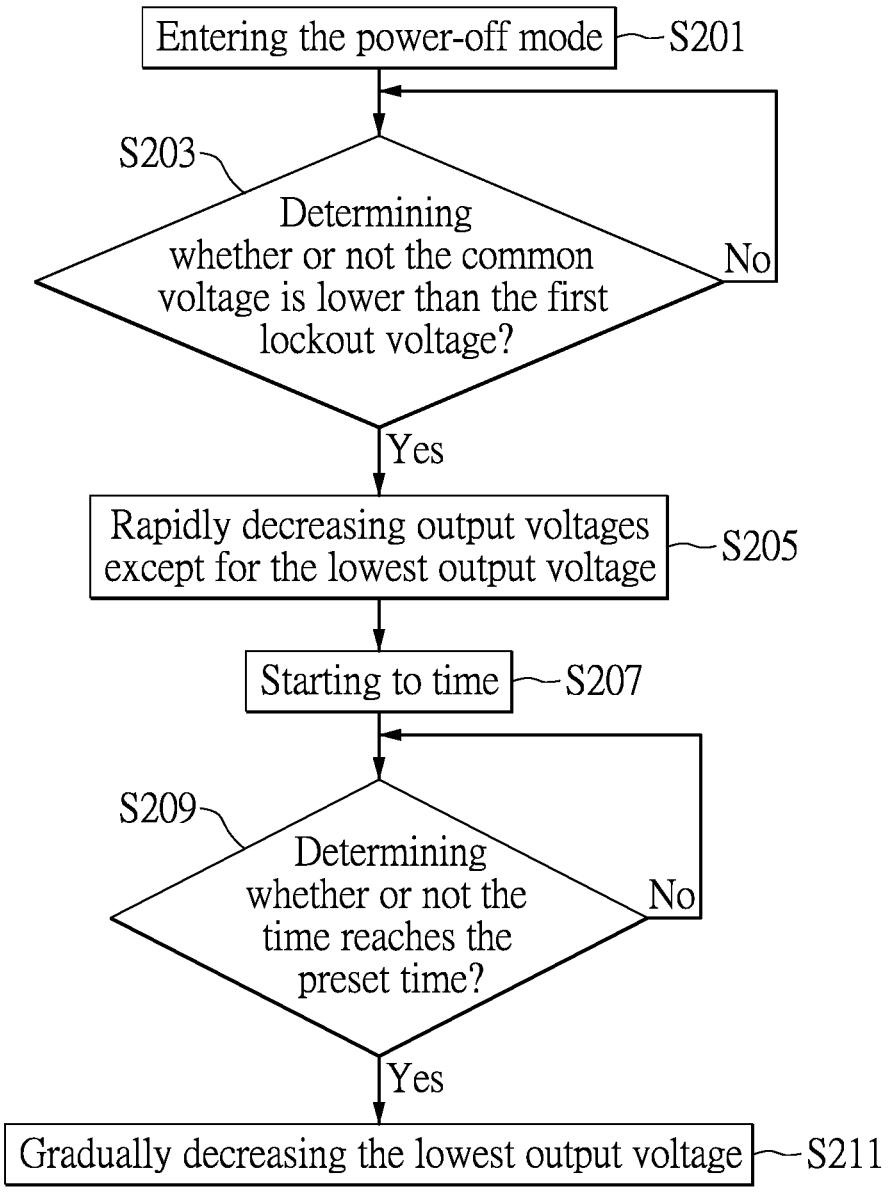
FIG. 2 is a second flowchart diagram of steps of the power managing method according to the embodiment of the present disclosure.

Reference is made to FIGS. 2 and 5, in which FIG. 2 is a second flowchart diagram of steps of the power managing method according to the embodiment of the present disclosure, and FIG. 5 is a block diagram of a power managing system according to the embodiment of the present disclosure.

The power managing method of the embodiment of the present disclosure may include steps S201 to S211 as shown in FIG. 2. Steps S201 to S211 may be performed by the power converter circuit 10, the under voltage lockout circuit 20, the main controller circuit 30 and a timer circuit 40 that are included in the power managing system as shown in FIG. 5. The main controller circuit 30 may be connected to the power converter circuit 10, the under voltage lockout circuit 20 and the timer circuit 40. The power converters PT1 to PTn of the power converter circuit 10 are configured to respectively supply the plurality of output voltages.

In step S201, the power managing system enters the power-off mode.

In step S203, the under voltage lockout circuit 20 determines whether or not the common voltage VCC decreases to be lower than the first lockout voltage such as the first lockout voltage UVLOH as shown in FIG. 7.

If the common voltage VCC does not decrease to be lower than the first lockout voltage, the under voltage lockout circuit 20 may continually detects the common voltage VCC and step S103 is performed again. Conversely, if the common voltage VCC decreases to be lower than the first lockout voltage, step S105 is performed.

In step S205, when the common voltage VCC decreases to be lower than the first lockout voltage, the under voltage lockout circuit 20 may output the first lockout voltage signal to the main controller circuit 30. The main controller circuit 30, according to the first lockout voltage signal, rapidly decreases the highest output voltage VH (or the output voltage of the power converter PT2) to the zero value, and rapidly decreases the other output voltages except for the lowest output voltage VL to the zero value.

In step S207, when the power converter PT2 to PTn start decreasing their output voltages to the zero value, the main controller circuit 30 controls the timer circuit 40 to start timing.

In step S209, the timer circuit 40 determines whether or not the time being currently timed by the timer circuit 40 reaches a preset time. If the time being currently timed by the timer circuit 40 does not reach the preset time, the timer circuit 40 continually times. Conversely, if the time being currently timed by the timer circuit 40 reaches the preset time, step S211 is performed.

In step S211, the timer circuit 40 outputs a timing signal to the main controller circuit 30. The main controller circuit 30, according to the timing signal, controls the power converter PT1 to gradually decrease the lowest output voltage VL to the zero value.

Figure 3:
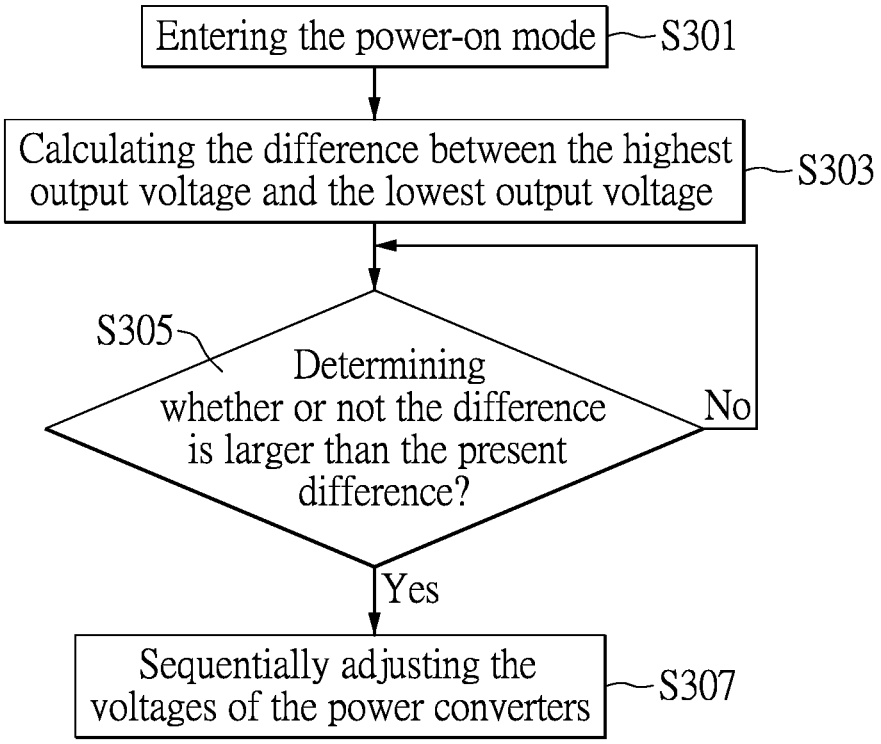
FIG. 3 is a third flowchart diagram of steps of the power managing method according to the embodiment of the present disclosure.

Reference is made to FIGS. 3 and 5, in which FIG. 3 is a third flowchart diagram of steps of the power managing method according to the embodiment of the present disclosure, and FIG. 5 is a block diagram of a power managing system according to the embodiment of the present disclosure. The power managing method of the embodiment of the present disclosure may include steps S301 to S307 as shown in FIG. 3. Steps S301 to S307 are applicable to the plurality of power converters PT1 to PTn of the power managing system. The power converters PT1 to PTn are configured to respectively supply the plurality of output voltages.

In step S301, the power managing system enters a power-on mode.

In step S303, a voltage difference detector circuit calculates the difference between a highest output voltage of the power converter circuit 10 (that is, the highest output voltage VH of the power converter PT2 as described above) and a lowest output voltage of the power converter circuit 10 (that is, the lowest output voltage VL of the power converter PT1 as described above).

In step S305, the voltage difference detector circuit determines whether or not the difference between the highest output voltage VH and the lowest output voltage VL is higher than a preset difference voltage. If the voltage difference detector circuit determines that the difference between the highest output voltage VH and the lowest output voltage VL is not higher than the preset difference voltage, step S305 is performed again. Conversely, if the voltage difference detector circuit determines that the difference between the highest output voltage VH and the lowest output voltage VL is higher than the preset difference voltage, the voltage difference detector circuit outputs a voltage difference detected signal to the main controller circuit 30, and then step S307 is performed.

In step S307, the main controller circuit 30, according to the voltage difference detected signal, rapidly decreases the highest output voltage VH (or the output voltage of the power converter PT2) to the zero value, and rapidly decreases output voltages of the power converters PT3 to PTn to the zero value.

Figure 6:
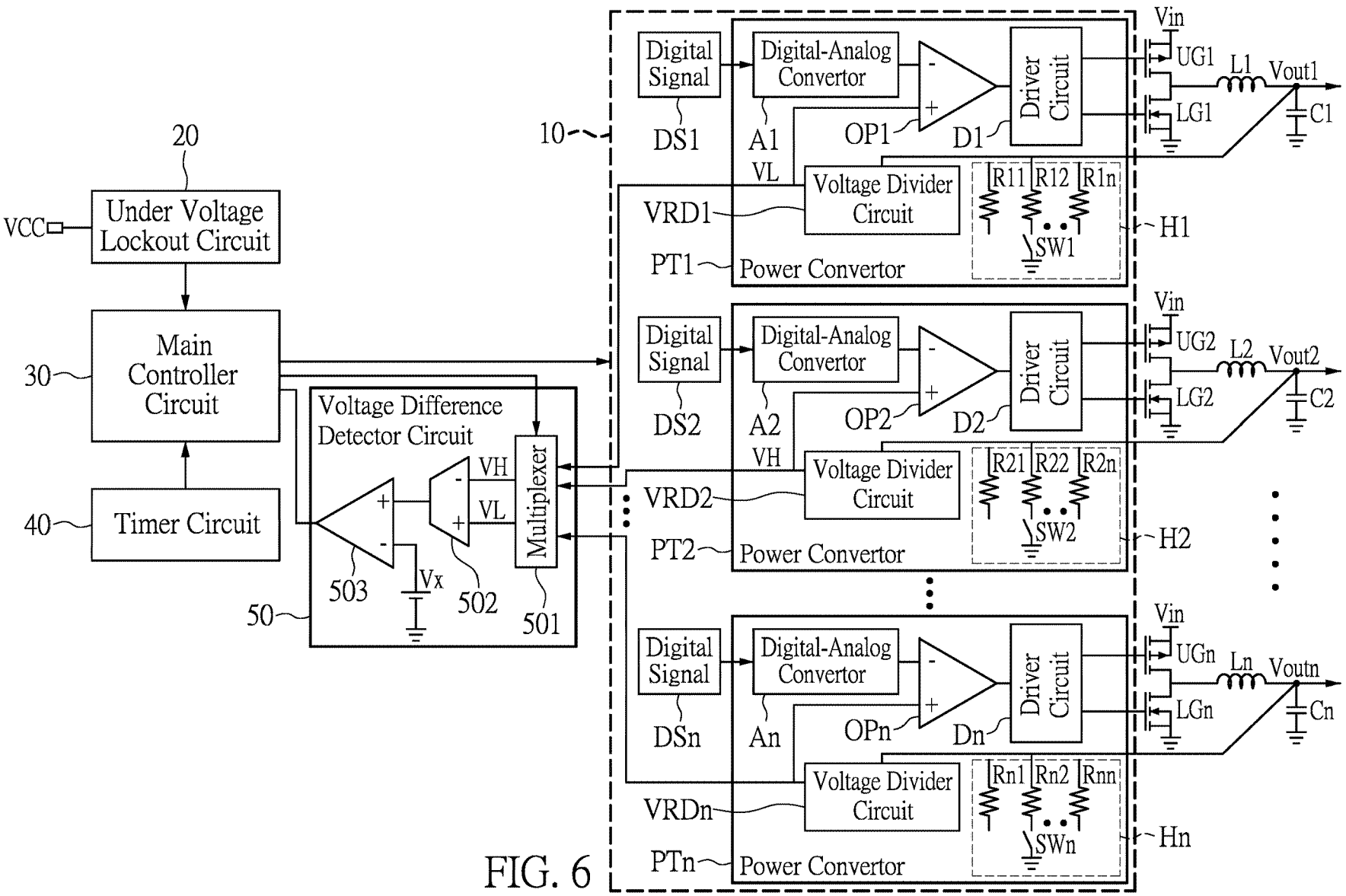
FIG. 6 is a circuit layout diagram of the power managing system according to the embodiment of the present disclosure.

Reference is made to FIGS. 6 and 7, in which FIG. 6 is a circuit layout diagram of the power managing system according to the embodiment of the present disclosure, and FIG. 7 is a waveform diagram of the power managing system and method according to the embodiment of the present disclosure.

Steps S301 to S307 of the power managing method as shown in FIG. 3 may be performed by the power managing system shown in FIG. 6. A configuration of each of the power converter PT2 to PTn of the power management system are the same or similar to that of the power converter PT1. Therefore, only details regarding the power converter PT1 is described in the following, but the configurations of the power converter PT2 to PTn are not repeated herein.

As shown in FIG. 6, the power converter PT1 may include a high-side switch UG1, a low-side switch LG1, an inductor L1, a capacitor C1, a driver circuit D1, an operational amplifier OP1, a digital-analog converter A1 and a voltage divider circuit VRD1, but the present disclosure is not limited thereto. In practice, the circuit components included in the power converter PT1 may be omitted. For example, the voltage divider circuit VRD1 may be omitted.

A node between a second terminal of an inductor L1 and a first terminal of a capacitor C2 is an output terminal of the power converter PT1. A first terminal of the high-side switch UG1 is coupled to an input voltage Vin. A second terminal of the high-side switch UG1 is connected to a first terminal of the low-side switch LG1. A node between the second terminal of the high-side switch UG1 and the first terminal of the low-side switch LG1 may be connected to a first terminal of the inductor L1. The second terminal of the inductor L1 is connected to a first terminal of the capacitor C1. A second terminal of the capacitor C1 is grounded.

A control terminal of the high-side switch UG1 and a control terminal of the low-side switch LG1 may be connected to an output terminal of the driver circuit D1. An input terminal of the driver circuit D1 may be connected to an output terminal of the operational amplifier OP1 and an output terminal of the main controller circuit 30. A first input terminal such as an inverting input terminal of the operational amplifier OP1 may be connected to the digital-analog converter A1. A second input terminal such as a non-inverting input terminal of the operational amplifier OP1 may be connected to the node between the second terminal of the inductor L1 and the first terminal of the capacitor C2 (through the voltage divider circuit VRD1).

The digital-analog converter A1 may be connected to an external digital signal supplying circuit (not shown in figures) and receive a digital signal DS1 from the external digital signal supplying circuit. The digital-analog converter A1 may convert the digital signal DS1 into an analog signal and outputs the analog signal to the first input terminal of the operational amplifier OP1.

The second input terminal such as the non-inverting input terminal of the operational amplifier OP1 may receive the output voltage Vout1 from the output terminal of the power converter PT1. Alternatively, in the embodiment, the second input terminal of the operational amplifier OP1 receives a voltage that is divided from the output voltage Vout1 by the voltage divider circuit VRD1. That is, the lowest output voltage VL shown in FIG. 6 is the output voltage Vout1 of the power converter PT1 or the voltage that is divided from the output voltage Vout1. Similarly, the highest output voltage VH shown in FIG. 6 is the output voltage Vout2 of the power converter PT2 or a voltage that is divided from the output voltage Vout2.

In the embodiment, among the output voltages Vout1 to Voutn respectively of the power converters PT1 to PTn of the power converter circuit 10, the output voltage Vout1 is the lowest output voltage VL and the output voltage Vout2 is the highest output voltage VH.

For example, as shown in FIG. 6, a voltage difference detector circuit 50 may include a multiplexer 501, an error amplifier 502 and a comparator 503. A plurality of input terminals of the multiplexer 501 may be connected to output terminals of the power converters PT1 to PTn respectively through voltage divider circuits VRD1 to VRDn. The input terminals of the multiplexer 501 may respectively receive output voltages Vout1 to Voutn from the power converters PT1 to PTn, or respectively receive the divided voltages of the output voltages Vout1 to Voutn from the voltage divider circuits VRD1 to VRDn.

The multiplexer 501 selects the highest one and the lowest one of the output voltages Vout1 to Voutn respectively of the power converters PT1 to PTn. Alternatively, the multiplexer 501 selects a highest one and a lowest one of the divided voltages. The highest one of the output voltages Vout1 to Voutn or the divided voltage thereof is represented by the highest output voltage VH. The lowest one of the output voltages Vout1 to Voutn or the divided voltage thereof is represented by the lowest output voltage VL. Then, the multiplexer 501 transmits the highest output voltage VH to a first input terminal such as an inverting input terminal of the error amplifier 502, and transmits the lowest output voltage VL to a second input terminal such as a non-inverting input terminal of the error amplifier 502.

The error amplifier 502 may calculate the difference between the highest output voltage VH and the lowest output voltage VL. The error amplifier 502 may amplify the difference to output an error amplified signal to a first input terminal such as a non-inverting input terminal of the comparator 503. A second input terminal such as an inverting input terminal of the comparator 503 may be coupled to a preset difference voltage Vx. The comparator 503 may compare a voltage of the error amplified signal and the preset difference voltage Vx to output the voltage difference detected signal to the main controller circuit 30. The main controller circuit 30 may, according to the voltage difference detected signal, adjust time points at which the power converters PT1 to PTn supply the output voltages and adjust values of the output voltages.

Figure 4:
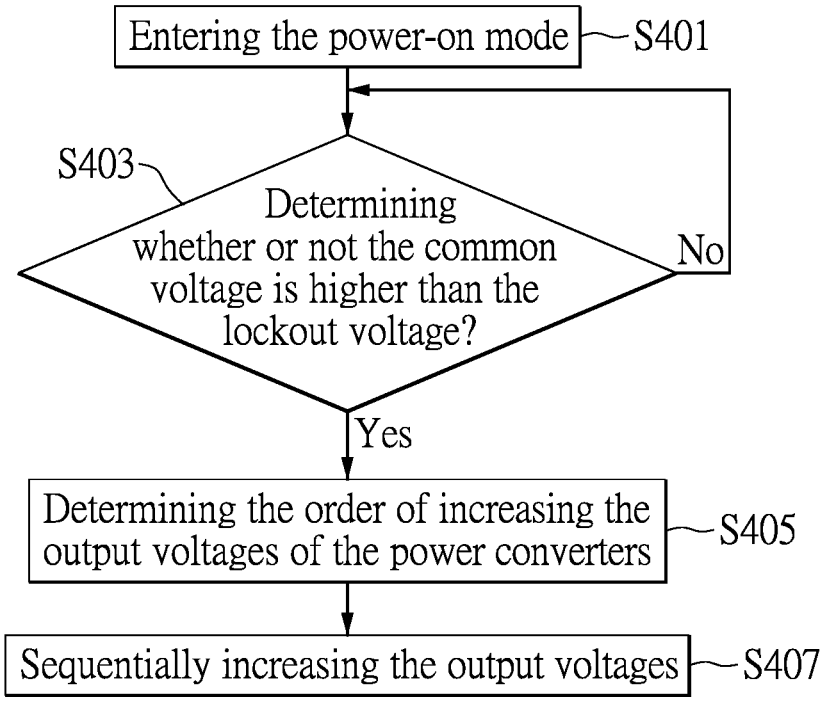
FIG. 4 is a fourth flowchart diagram of steps of the power managing method according to the embodiment of the present disclosure.

Reference is made to FIGS. 4, 5 and 7, in which FIG. 4 is a fourth flowchart diagram of steps of the power managing method according to the embodiment of the present disclosure, FIG. 5 is a block diagram of a power managing system according to the embodiment of the present disclosure, and FIG. 7 is a waveform diagram of the power managing system and method according to the embodiment of the present disclosure.

The power managing method of the embodiment of the present disclosure may include steps S401 to S407 as shown in FIG. 4. Steps S401 to S407 may be performed by the power managing system shown in FIG. 5.

In step S401, the power managing system enters the power-on mode.

In step S403, the under voltage lockout circuit 20 determines whether or not the common voltage VCC used by the power managing system is higher than the lockout voltage such as the lockout voltage UVLO as shown in FIG. 7.

If the common voltage VCC is not higher than the lockout voltage, the under voltage lockout circuit 20 continually detects the common voltage VCC, and step S403 is performed again. Conversely, if the common voltage VCC is higher than the lockout voltage, step S405 is performed.

In step S405, an order of sequentially increasing the output voltages Vout1 to Voutn of the power converters PT1 to PTn is determined.

In step S407, the output voltages Vout1 to Voutn respectively of the power converters PT1 to PTn are sequentially increased, based on the order determined in step S405. As shown in FIG. 7, the time points at which the output voltages Vout1 to Vout6 of the power converters PT1 to PT6 respectively start increasing are different to each other. In particular, the time point at which the highest output voltage VH starts increasing is different from the time point at which the lowest output voltage VL starts increasing.

For example, as shown in FIG. 7, the time point at which the lowest output voltage VL starts increasing may be earlier than the time point at which the highest output voltage VH starts increasing.

Reference is made to FIG. 6, which is a circuit layout diagram of the power managing system according to the embodiment of the present disclosure.

As shown in FIG. 6, the power converters PT1 to PTn of the power managing system of the embodiment of the present disclosure may respectively include discharging circuits H1 to Hn.

The configuration of each of the power converter PT2 to PTn of the power management system are the same or similar to that of the power converter PT1. Therefore, only the power converter PT1 is descried in detail in the following, but the configurations of the power converter PT2 to PTn are not repeated herein.

In the power converter PT1, the discharging circuits H1 to Hn may be connected to the node between the second terminal of the inductor L1 and the first terminal of the capacitor C2. The discharging circuit H1 may be configured to adjust (a discharge rate of) the output voltage Vout1 of the node between the second terminal of the inductor L1 and the first terminal of the capacitor C2.

For example, as shown in FIG. 6, the discharging circuit H1 may include a plurality of resistors R11 to R1*n* and a switch component SW1, but the present disclosure is not limited thereto. Resistances of the resistors R11 to R1*n* may be the same or different from each other. The resistors R11 to R1*n* may be connected to each other in parallel (or in series). A first terminal of each of the resistors R11 to R1*n* may be connected to the node between the second terminal of the inductor L1 and the first terminal of the capacitor C2. A second terminal of each of the resistors R11 to R1*n* may be grounded.

A control terminal of the switch component SW1 may be connected to the main controller circuit 30. A first terminal of the switch component SW1 may be connected to the second terminal of each of the resistors R11 to R1*n*. A second terminal of the switch component SW1 may be grounded. When the main controller circuit 30 determines that (the discharge rate of) the output voltage Vout1 of the node between the second terminal of the inductor L1 and the first terminal of the capacitor C2 needs to adjusted, the main controller circuit 30 may turn on or off the switch component SW1.

It should be understood that, a number of the resistors R11 to R1*n* included in the discharging circuit H1 may be adjusted according to actual requirements. In practice, the discharging circuit H1 may only include one of the resistors R11 to R1*n* and the switch component SW1 may be omitted according to actual requirements.

Alternatively, in practice, the discharging circuit H1 may include a plurality of switch components (not shown in figures). First terminals of the switch components are respectively connected to the first terminals of the resistors R11 to R1*n*. A second terminal of each of the switch components is grounded. A control terminal of each of the switch components is connected to the main controller circuit 30. The main controller circuit 30 may optionally turn on the switch components, according to a desired discharge rate of the output voltage Vout1 of the node between the second terminal of the inductor L1 and the first terminal of the capacitor C2. As a result, the node between the second terminal of the inductor L1 and the first terminal of the capacitor C2 is connected to a ground through the switch components being turned on and one or more of the resistors R11 to R1*n*.

In addition, the main controller circuit 30 may, according to the desired discharge rate of the output voltage Vout1 of the node between the second terminal of the inductor L1 and the first terminal of the capacitor C2, determine an on-time within which the low-side switch LG1 is turned on and determine an off-time within which the low-side switch LG1 is turned off. The main controller circuit 30 turns on the low-side switch LG1 within the on-time and turns off the low-side switch LG1 within the off-time. For example, when the main controller circuit 30 determines that the discharge rate of the output voltage Vout1 of the node between the second terminal of the inductor L1 and the first terminal of the capacitor C2 needs to be increased, the main controller circuit 30 may continually turn on the low-side switch LG1 for periods of time.

In summary, the present disclosure provides the power managing system and method. The output voltages of the power converters are controlled to start increasing or decreasing respectively at different time points. In particular, the highest one and the lowest one of the output voltages of the power converter circuit are decreased to the zero value respectively within the different time intervals. As a result, an excessive voltage difference between each two ones of the output voltages of the power converter circuit can be prevented from appearing within a same one of the time intervals. Therefore, when circuit components (such as the single chip of the system) receive the output voltages of the power converters, the circuit components cannot be damaged by the excessive voltage difference.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A power managing system, comprising:

a power converter circuit including a plurality of power converters respectively configured to supply a plurality of output voltages, wherein one of the plurality of power converters that supplies a lowest one of the plurality of output voltages is defined as a first power converter, and another one of the plurality of power converters that supplies a highest one of the plurality of output voltages is defined as a second power converter; and an under voltage lockout circuit coupled to a common voltage and connected to the power converter circuit;

wherein, when the under voltage lockout circuit determines that the common voltage is lower than a first lockout voltage, the under voltage lockout circuit outputs a first under voltage lockout signal to the second power converter, and then the second power converter rapidly decreases the output voltage of the second power converter to a zero value according to the first under voltage lockout signal;

wherein, after the output voltage of the second power converter decreases to the zero value, the under voltage lockout circuit outputs a second under voltage lockout signal to the first power converter, and then the first power converter gradually decreases the output voltage of the first power converter to the zero value according to the second under voltage lockout signal.

2. The power managing system according to claim 1, wherein, after the output voltage of the second power converter rapidly decreases to the zero value, the under voltage lockout circuit determines whether or not the common voltage decreases to be lower than a second lockout voltage being lower than the first lockout voltage;

wherein, when the common voltage decreases to be lower than the second lockout voltage, the under voltage lockout circuit outputs the second under voltage lockout signal to the first power converter, and then the first power converter gradually decreases the output voltage of the first power converter to the zero value according to the second under voltage lockout signal.

3. The power managing system according to claim 1, further comprising:

a main controller circuit connected to the power converter circuit and the under voltage lockout circuit, wherein the main controller circuit is configured to control the second power converter according to the first under voltage lockout signal from the under voltage lockout circuit, and to control the first power converter according to the second under voltage lockout signal from the under voltage lockout circuit.

4. The power managing system according to claim 3, further comprising:

a timer circuit connected to the main controller circuit, wherein, when the output voltage of the second power converter starts decreasing, the main controller circuit controls the timer circuit to start timing;

wherein, when a time being currently timed by the timer circuit reaches a preset time, the timer circuit outputs a timing signal to the main controller circuit, and then the main controller circuit controls the first power converter to gradually decrease the output voltage of the first power converter to zero value according to the timing signal.

5. The power managing system according to claim 3, wherein, when the common voltage decreases to be lower than the first lockout voltage, the under voltage lockout circuit outputs a voltage-decreasing instruction signal to the main controller circuit, and then the main controller circuit controls the second power converter to decrease the output voltage of the second power converter based on a reference voltage indicated by the voltage-decreasing instruction signal.

6. The power managing system according to claim 3, further comprising:

a voltage difference detector circuit connected to the main controller circuit and the power converter circuit, and configured to calculate a difference between the highest one of the plurality of output voltages and the lowest one of the plurality of output voltages;

wherein, when the voltage difference detector circuit determines that the difference is higher than a preset difference voltage, the voltage difference detector circuit outputs a voltage difference detected signal to the main controller circuit;

wherein, the voltage difference detector circuit controls the power converters according to the voltage difference detected signal, such that a time point at which the highest one of the plurality of output voltages starts gradually increasing is not the same as a time point at which the lowest one of the plurality of output voltages starts gradually increasing, or such that a time point at which the highest one of the plurality of output voltages starts gradually decreasing is not the same as a time point at which the lowest one of the plurality of output voltages starts gradually decreasing.

7. The power managing system according to claim 6, wherein the voltage difference detector circuit includes a multiplexer, an error amplifier and a comparator, wherein an input terminal of the multiplexer is connected to the power converter circuit, an output terminal of the multiplexer is connected to a first input terminal of the error amplifier and a second input terminal of the error amplifier, a first input terminal of the comparator is connected to an output terminal of the error amplifier, a second input terminal of the comparator is coupled to the preset difference voltage, and an output terminal of the comparator is connected to an input terminal of the main controller circuit;

wherein the multiplexer selects the highest one of the plurality of output voltages and outputs the highest one of the plurality of output voltages to the first input terminal of the error amplifier;

wherein the multiplexer selects the lowest one of the plurality of output voltages and outputs the lowest one of the plurality of output voltages to the second input terminal of the error amplifier;

wherein the error amplifier amplifies the difference between the highest one of the plurality of output voltages and the lowest one of the plurality of output voltages to output an error amplified signal to the first input terminal of the comparator, and the comparator compares a voltage of the error amplified signal with the preset difference voltage to output the voltage difference detected signal to the main controller circuit.

8. The power managing system according to claim 3, wherein each of the plurality of power converters includes a high-side switch, a low-side switch and a driver circuit;

wherein a first terminal of the high-side switch is coupled to an input voltage, a second terminal of the high-side switch is connected to a first terminal of the low-side switch, a second terminal of the low-side switch is grounded, a node between the second terminal of the high-side switch and the first terminal of the low-side switch is connected to a first terminal of an inductor, a second terminal of the inductor is connected to a first terminal of a capacitor, a second terminal of the capacitor is grounded, the driver circuit is connected to a control terminal of the high-side switch and a control terminal of the low-side switch, and the main controller circuit is connected to the driver circuit.

9. The power managing system according to claim 8, wherein each of the plurality of power converters further includes an operational amplifier, a first input terminal of the operational amplifier is connected to a digital-analog converter and receives an analog signal from the digital-analog converter, and a second input terminal of the operational amplifier is connected to a node between the second terminal of the inductor and the first terminal of the capacitor.

10. The power managing system according to claim 9, wherein each of the plurality of power converters further includes a voltage divider circuit, an input terminal of the voltage divider circuit is connected to the node between the second terminal of the inductor and the first terminal of the capacitor, an output terminal of the voltage divider circuit is connected to the input terminal of the multiplexer, and the second input terminal of the operational amplifier is connected to the node between the second terminal of the inductor and the first terminal of the capacitor through the voltage divider circuit.

11. The power managing system according to claim 8, wherein each of the plurality of power converters further includes a discharging circuit, the discharging circuit is connected to the node between the second terminal of the inductor and the first terminal of the capacitor, and the discharging circuit is configured to adjust a voltage of the node between the second terminal of the inductor and the first terminal of the capacitor.

12. The power managing system according to claim 11, wherein the discharging circuit includes a plurality of resistors that are connected to each other in parallel, a first terminal of each of the plurality of resistors is connected to the node between the second terminal of the inductor and the first terminal of the capacitor, and a second terminal of each of the plurality of resistors is grounded.

13. The power managing system according to claim 12, wherein the discharging circuit of each of the plurality of power converter further include a switch component, a control terminal of the switch component is connected to the main controller circuit, a first terminal of the switch component is connected to a second terminal of each of the plurality of resistors, and a second terminal of the switch component is grounded.

14. The power managing system according to claim 8, wherein, when the common voltage decreases to be lower than the first lockout voltage, the driver circuit turns on the low-side switch in the second power converter such that a speed at which the output voltage of the second power converter decreases to the zero value is accelerated.

15. A power managing method, comprising the following steps:

(a) supplying a plurality of output voltages respectively by a plurality of power converters, defining one of the plurality of power converters that supplies a lowest one of the plurality of output voltages as a first power converter, and defining another one of the plurality of power converters that supplies a highest one of the plurality of output voltages as a second power converter;

(b) detecting a common voltage used by the plurality of power converters;

(c) determining whether or not the common voltage decreases to be lower than a first lockout voltage, in response to determining that the common voltage does not decrease to be lower than the first lockout voltage, continually detecting the common voltage, and in response to determining that the common voltage decreases to be lower than the first lockout voltage, performing a next step;

(d) calculating a difference between the highest one of the plurality of output voltages and the lowest one of the plurality of output voltages;

(e) determining whether or not the difference between the highest one of the plurality of output voltages and the lowest one of the plurality of output voltages is higher than a preset difference voltage, in response to determining that the difference is not higher than the preset difference voltage, returning to the previous step (d), and in response to determining that the difference is higher than the preset difference voltage, performing the next step (f);

(f) controlling the power converters such that a time point at which the highest one of the plurality of output voltages starts gradually decreasing is not the same as a time point at which the lowest one of the plurality of output voltages starts gradually decreasing.

16. The power managing method according to claim 15, further comprising the following steps:

after the output voltage of the second power converter is rapidly decreased to the zero value, determining whether or not the common voltage decreases to be lower than a second lockout voltage, in response to determining that the common voltage does not decrease to be lower than the second lockout voltage, continually detecting the common voltage and determining whether or not the common voltage decreases to be lower than the second lockout voltage, and in response to determining that the common voltage decreases to be lower than the second lockout voltage, performing the next step; and gradually decreasing the output voltage of the first power converter to the zero value.

17. The power managing method according to claim 15, further comprising the following steps:

start timing when the output voltage of the second power converter is rapidly decreased to the zero value; and determining whether or not a time being currently timed by the timer circuit reaches a preset time, in response to determining that the time does not reach the preset time, returning to the previous step to continue timing, and in response to determining that the time reaches the preset time, controlling the first power converter to gradually decrease the output voltage of the first power converter to the zero value.

18. The power managing method according to claim 15, further comprising the following steps:

determining whether or not the common voltage decreases to be lower than the first lockout voltage, in response to determining that the common voltage does not decrease to be lower than the first lockout voltage, continually detecting the common voltage and determining whether or not the common voltage decreases to be lower than the first lockout voltage, and in response to determining that the common voltage decreases to be lower than the first lockout voltage, performing a next step; and controlling the second power converter to decrease the output voltage of the second power converter based on a reference voltage.

19. The power managing method according to claim 15, further comprising the following step:

determining whether or not the difference is higher than the preset difference voltage, in response to determining that the difference is not higher than the preset difference voltage, returning to the previous step of calculating the difference between the highest one of the plurality of output voltages and the lowest one of the plurality of output voltages, and in response to determining that the difference is higher than the preset difference voltage, controlling the power converters such that a time point at which the highest one of the plurality of output voltages starts gradually increasing is not the same as a time point at which the lowest one of the plurality of output voltages starts gradually increasing.

* * * * *